US007201175B2

(12) United States Patent
DeBoer et al.

(10) Patent No.: US 7,201,175 B2
(45) Date of Patent: Apr. 10, 2007

(54) USER INTERFACE FOR AN IN-SINK DISHWASHER

(75) Inventors: John M. DeBoer, St. Joseph, MI (US); Jeff M. Borah, St. Joseph, MI (US); Randall K. Statzer, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 616 days.

(21) Appl. No.: 10/273,774

(22) Filed: Oct. 18, 2002

(65) Prior Publication Data

US 2003/0205250 A1 Nov. 6, 2003

Related U.S. Application Data

(60) Provisional application No. 60/319,224, filed on May 3, 2002.

(51) Int. Cl.
*B08B 3/02* (2006.01)

(52) U.S. Cl. ..... 134/57 D; 134/56 D; 134/57 D; 134/115 R; 134/201

(58) Field of Classification Search ..... 134/115 R, 134/56 D, 57 D, 58 D, 176, 179, 201
See application file for complete search history.

(56) References Cited

U.S. PATENT DOCUMENTS

| | | | | |
|---|---|---|---|---|
| 1,995,331 | A | 3/1935 | Snyder et al. | 141/9 |
| 2,418,366 | A | 4/1947 | Powers | 134/57 |
| 2,632,452 | A * | 3/1953 | Spitzer | 134/115 R |
| 3,595,253 | A * | 7/1971 | Yanez-Pastero | 134/105 |
| 3,961,984 | A * | 6/1976 | Torressen | 134/100.1 |
| 4,362,954 | A | 12/1982 | Cotton | |
| 4,420,005 | A * | 12/1983 | Armstrong | 134/100.1 |
| 4,542,756 | A * | 9/1985 | Gibson | 134/177 |
| 4,557,283 | A * | 12/1985 | Shaw | 134/177 |
| 4,739,781 | A | 4/1988 | Casoli | 134/115 |
| 4,919,162 | A * | 4/1990 | Lumby et al. | 134/115 R |
| 5,193,562 | A * | 3/1993 | Rigby et al. | 134/57 D |

(Continued)

FOREIGN PATENT DOCUMENTS

DE 3110886 9/1982

(Continued)

OTHER PUBLICATIONS

Patent Abstracts of Japan, Publication No.: 2001-087198, Publication Date: Mar. 4, 2001.

(Continued)

*Primary Examiner*—Joseph L. Perrin
(74) *Attorney, Agent, or Firm*—Robert O. Rice; Stephen Krefman; John F. Colligan

(57) ABSTRACT

A dish-cleaning appliance comprises a sink having a bowl defining a wash chamber with an open top for providing access to the wash chamber. A liquid recirculation system is provided for spraying liquid throughout the wash chamber. A drain conduit can be provided, alone or in combination with the recirculation system, for draining liquid from the wash chamber when the drain is closed. The lid is mounted to the sink and is movable to selectively cover the open top of the bowl and a user interface located in the sink.

48 Claims, 18 Drawing Sheets

U.S. PATENT DOCUMENTS

| | | | | |
|---|---|---|---|---|
| 5,193,669 | A | 3/1993 | Demeo et al. | 200/512 |
| 5,340,955 | A | 8/1994 | Calvillo et al. | 200/302.2 |
| 5,365,959 | A | 11/1994 | Favaro | 134/113 |
| 5,430,266 | A | 7/1995 | Austin, Jr. et al. | 200/302 |
| 5,453,586 | A | 9/1995 | Stottmann | 200/5 A |
| 5,578,802 | A | 11/1996 | Palmowski | 200/5 A |
| 5,734,136 | A | 3/1998 | Newcomer et al. | 200/5 A |
| 5,988,193 | A * | 11/1999 | Hernandez | 134/184 |
| 6,169,256 | B1 | 1/2001 | Hanahara et al. | 200/5 A |
| 6,204,459 | B1 | 3/2001 | Kizele et al. | 200/302.1 |

FOREIGN PATENT DOCUMENTS

| | | | |
|---|---|---|---|
| DE | 3220981 | | 12/1982 |
| EP | 0688607 | A1 | 12/1995 |
| EP | 0944147 | A1 | 9/1999 |
| EP | 1120802 | A2 | 8/2001 |
| FR | 2587833 | | 3/1987 |
| GB | 2206039 | A | 6/1988 |
| JP | 01250214 | | 10/1989 |

OTHER PUBLICATIONS

Patent Abstracts of Japan, Publication No.: 2001-00377, Publication Date: Sep. 1, 2001.

* cited by examiner

USER INTERFACE FOR AN IN-SINK DISHWASHER

BACKGROUND OF THE INVENTION

1. Field of the Invention

The invention relates to an in-sink dishwasher for automatically washing household dishes without requiring the physical space of a built-in automatic dishwasher. The invention further relates to the dishwasher having a user interface mounted within the sink and which is covered by the lid when the lid is closed. The invention also relates to a liquid sealed user interface.

2. Description of the Related Art

In-sink dishwashers use the bowl of a sink to form part of the dishwasher housing that defines a wash chamber, with the open top of the bowl providing access to the wash chamber. A liquid recirculation system sprays wash liquid throughout the wash chamber to clean any dishes placed within. A lid covers the open top of the bowl when the in-sink dishwasher is being used to prevent the splashing or spraying of the recirculating wash liquid out of the open top of the bowl.

When the lid is closed, it is anticipated that the consumer will use the upper surface of the lid as a work surface, which may well include the preparation of food and the like. If a user interface is provided for the consumer to select the dish washing cycle and the corresponding parameters, if any, it is desirable to locate the user interface in a position where the user will not accidentally contact the user interface while the lid is used as a work surface. The accidental contacting of the user interface might undesirably impact the selected wash cycle, including prematurely terminating the wash cycle, selecting an unwanted wash cycle, or changing an operating parameter.

Since the user interface is likely to be exposed to liquid, it is also desirable to seal the user interface against liquid to protect metal components from oxidation associated with exposure to liquid and electrical components against damage.

SUMMARY OF THE INVENTION

The invention relates to an in-sink dishwasher with a user interface located in the sink. The dishwasher comprises a sink having a bowl with a bottom wall from which extends a peripheral side wall that terminates in a peripheral flange, with the bottom wall and peripheral wall collectively defining a wash chamber with an open top for receiving dishes to be washed. A lid is movably mounted to the sink for movement between an opened position, permitting access to the wash chamber through the open top, and a closed position where the lid covers the open top. A control system for controlling the operation of the dishwasher is provided. The control system includes a user interface mounted to the peripheral flange of the sink.

The lid is sized such that the lid overlies and covers the user interface when the lid is in the closed position. A portion of the peripheral flange can form a step defined by a peripheral lip, with the user interface being located on the lip. The lip can be spaced below the remainder of the peripheral flange a sufficient amount such that the lid nests within the step when the lid is in the closed position.

In one aspect, the user interface comprises a circuit board having a plurality of switches that are accessible through an opening in the peripheral flange. A template can be provided in an overlying relationship to the switches to at least partially seal the switches relative to the opening in the peripheral flange so that liquid on the peripheral flange at the opening cannot reach the switches.

A cover plate can be used to support the template. The cover plate is in sealing arrangement with the peripheral flange. The mounting of the template to the cover plate can be accomplished by over molding the template onto the cover plate. The template can be made from a compressible material such that the template is compressed at the interface with the edge of the peripheral flange to enhance the seal.

A gasket can also be used to form the seal between the between the cover plate and the peripheral flange. The gasket circumscribes the opening in the peripheral flange and bears against a lower surface of the peripheral flange. The cover plate can have a channel in which the gasket is received.

The user interface can also include a spacer disposed between the cover plate and the circuit board and overlying the plurality of switches, with a portion of the spacer abutting the cover plate to seal the circuit board relative to the cover plate. The spacer can be made from an elastic material and have a plurality of actuators, with each actuator corresponding to one of the switches such that the movement of an actuator actuates the corresponding switch. The template can also have a plurality of buttons, with each button corresponding to one of the actuators such that the movement of a button moves the corresponding actuator to actuate the corresponding switch.

A bracket can be provided for mounting the circuit board to the sink. The bracket is mounted to the sink and the circuit board is mounted to the bracket to mount the circuit board to the sink. The spacer abuts the bracket to seal the circuit board relative to the bracket.

The circuit board is vertically oriented and the switches are located along an upper edge of the circuit board. The bracket has a slot in which at least a portion of the circuit board is received to mount the circuit board to the bracket. The bracket has a generally planar base in which the channel is formed, a side wall extending downward from the base, and at least one leg connecting the side wall to the base.

In another aspect, the invention relates to user interface having multiple seals relative to the sink. The user interface comprises a bracket mounted to the sink and to which the circuit board is mounted to thereby mount the circuit board to the sink. A first seal seals the circuit board relative to the bracket and a second seal seals the first seal relative to the peripheral flange.

The first seal can comprise a membrane overlying the plurality of switches and abutting the bracket to seal the circuit board relative to the bracket. The membrane has at least one actuator corresponding to one of the switches, whereby the movement of the actuator actuates the corresponding switch.

The second seal comprises a plate having one surface abutting the membrane and a second surface abutting the peripheral flange to form the seal between the first seal and the peripheral flange. The second seal can also include a gasket positioned between the second surface and the peripheral flange.

A template can be mounted to the plate and have at least one button that corresponds to the at least one actuator, whereby the pressing of the button moves the corresponding actuator to actuate the corresponding switch.

Another embodiment of the invention relates to a user interface for use by a user to set operational parameters of an appliance. The user interface comprises a circuit board having a plurality of switches for setting the operational parameters, a housing for mounting the circuit board to the appliance, the housing having an opening in which the circuit board is received such that the plurality of switches are accessible exteriorly of the housing when the circuit board is mounted to the housing, and a membrane overlying the plurality of switches and mounted to the housing to seal the housing opening.

The membrane can have at least one actuator, which corresponds to one of the switches such that the movement of an actuator actuates the corresponding switch. The bracket has a channel substantially circumscribing the opening and the membrane is received within the bracket channel to form a seal between the membrane and the bracket.

The circuit board can be vertically oriented and the plurality of switches are located along an upper edge of the circuit board such that the switches are aligned with the opening. The bracket can include a slot in which at least a portion of the circuit board is received to mount the circuit board to the bracket.

In a more detailed form, the bracket has a generally planar base in which the channel is formed, a side wall extending downward from the base, and at least one leg connecting the side wall to the base, wherein the slot extends through the base and into the at least one leg, whereby when the circuit board is mounted in the slot, the side wall serves to isolate the circuit board from the appliance.

The circuit board can also include at least one light source. The membrane overlies the light source and has an opacity that permits the transmission of light from the light source through the membrane.

A template can be coupled to the membrane and have at least one button, which corresponds to one of the actuators, wherein the pressing of the button moves the corresponding actuator to actuate the corresponding switch. The at least one button is formed by a raised portion of the template. The template can have a transmissive portion corresponding to the light source such that the light transmitted by the light source is visible through the transmissive portion. The transmissive portion can be colored.

In yet another embodiment, the invention relates to a reduced profile, water-tight user interface for use by a user to set operational parameters of an appliance used in a wet environment and accessible through an opening in an outer housing of the appliance. The user interface comprises a circuit board comprising a generally planar body having an upper edge and a plurality of switches located on the upper edge for setting the operational parameters, a bracket for mounting the circuit board to the appliance such that the switches are accessible through the housing opening, the bracket having a face that supports the upper edge of the circuit board and a side that supports the planar body, with the face being adapted to mount adjacent the housing opening, a membrane overlying the plurality of switches and mounted to the bracket face to seal the switches relative to the bracket.

The bracket defines a slot extending from the face and along the side, with the slot having a width slightly larger than the thickness of the circuit board planar body to thereby slidably receive the circuit board within the slot. The face has a channel that circumscribes the slot and the channel receives a portion of the membrane to seal the circuit board relative to the bracket. The membrane can comprise at least one actuator, which corresponds to one of the switches such that the movement of an actuator actuates the corresponding switch.

A template can be coupled to the membrane and have at least one button that corresponds to the at least one actuator, whereby the pressing of the button moves the corresponding actuator to actuate the corresponding switch.

DESCRIPTION OF THE PREFERRED EMBODIMENT

Figure 1:
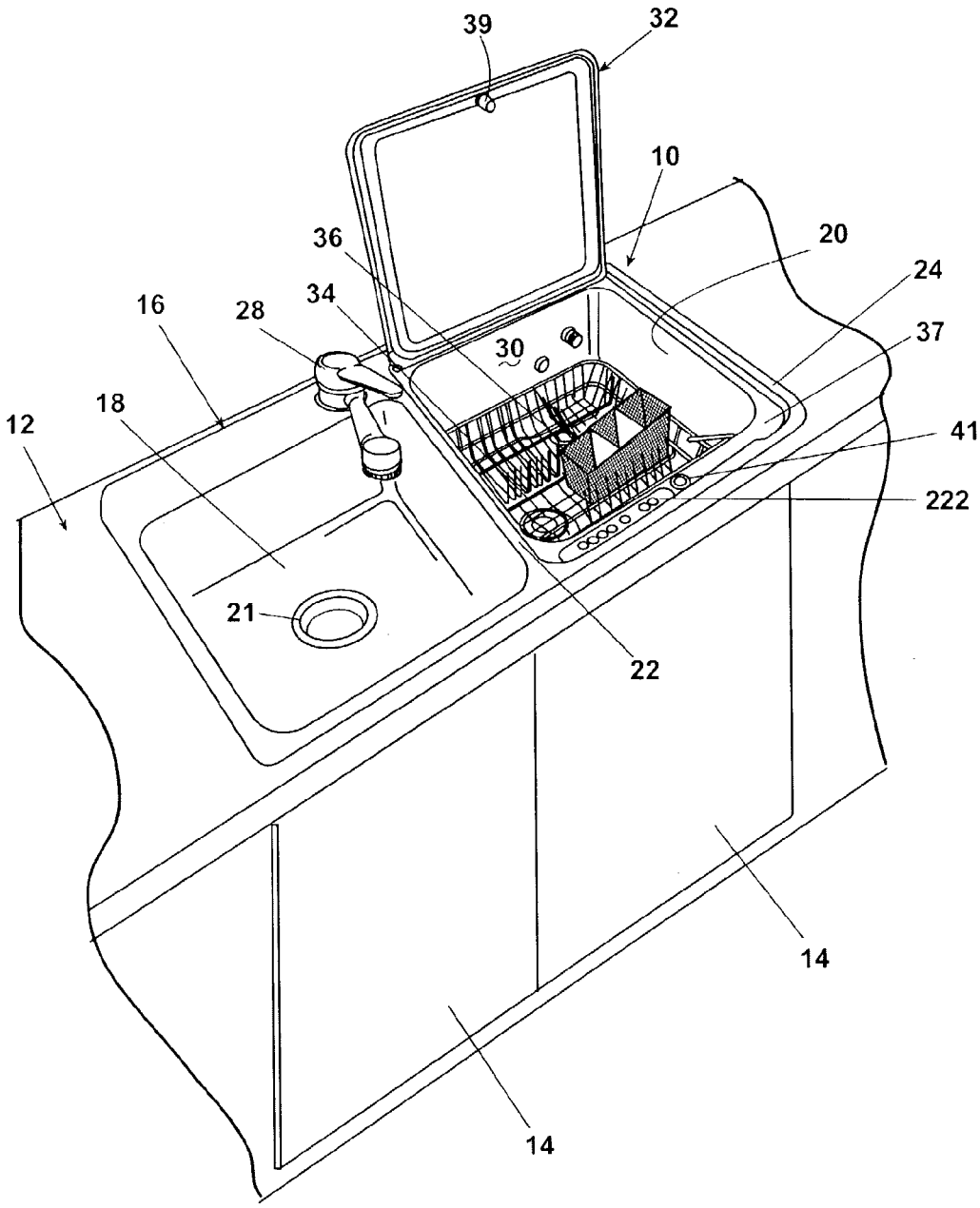
FIG. 1 is a perspective view of an in-sink dishwasher according to the invention, with the in-sink dishwasher shown mounted in a cabinet, the sink being of a double-bowl configuration and the one bowl forming part of the in-sink dishwasher having a lid, shown in an opened position, for covering the one bowl, and a user interface located at the periphery of the bowl.
Figure 2:
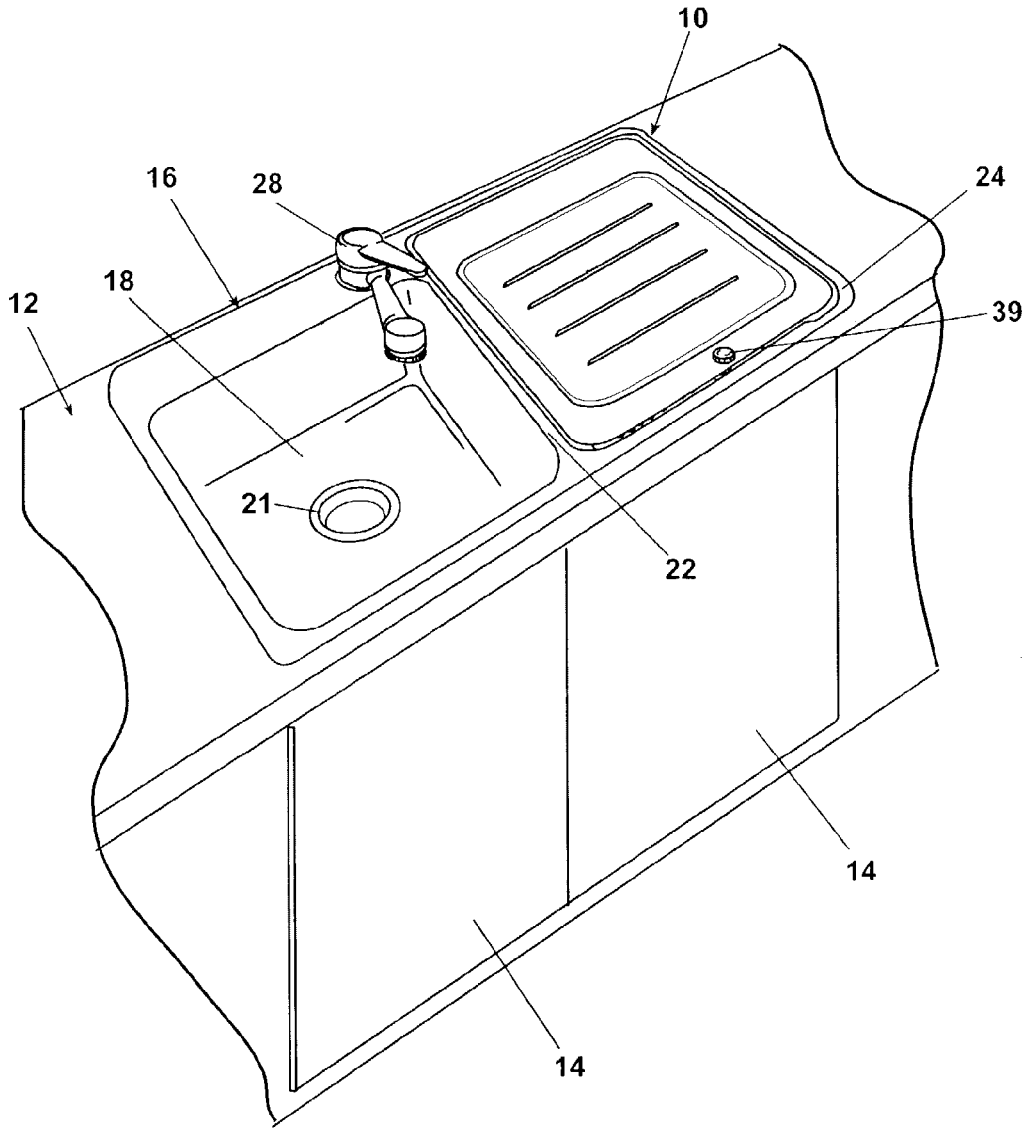
FIG. 2 is a perspective view identical to FIG. 1 except that the lid is shown in the closed position, covering the user interface.

FIG. 1 illustrates an in-sink dishwasher 10 mounted in a traditional cabinet fixture 12 having doors 14 providing access to the cabinet interior where the lower portion of the in-sink dishwasher 10 is located.

The in-sink dishwasher 10 is illustrated in the environment of a double-bowl sink 16 comprising a first bowl 18 and a second bowl 20. The first bowl 18 performs the function of a traditional sink bowl and includes a drain opening 21. The second bowl 20 performs the dual function of a traditional sink bowl while also forming a portion of the housing for the in-sink dishwasher.

The first and second bowls 18, 20 are spaced from each other to define an intervening flange portion 22 that intersects a peripheral flange 24 surrounding both of the bowls 18, 20. Preferably, the double-bowl sink is made from stainless steel. In a single-bowl configuration, the intermediate flange would form part of the peripheral flange for the bowl 20.

A traditional water faucet 28 is located in the peripheral flange 24 of the double-bowl sink and provides water to either of the first and second bowls 18, 20.

Figure 3:
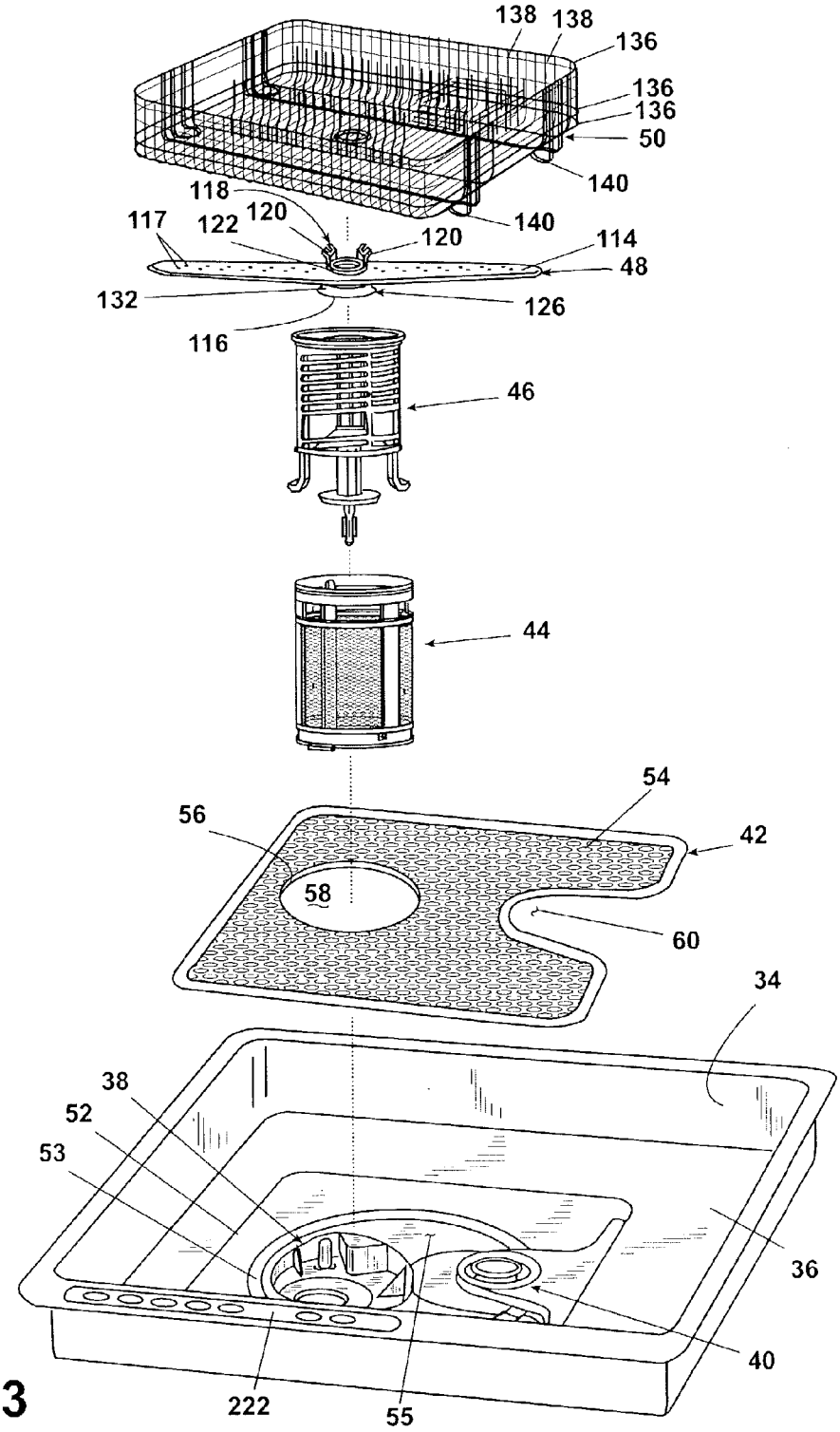
FIG. 3 is an assembly view of the in-sink dishwasher of FIG. 1 and illustrating the assembly of the major removable components of the in-sink dishwasher which include the basket, spray arm, drain plug, drain filter, and bottom screen.

Referring to FIG. 3 specifically and FIG. 1 generally, the in-sink dishwasher comprises a wash chamber 30 that is defined by the second bowl 20, which has an open top. A lid 32 is hinged mounted to the peripheral flange 24 of the double-bowl sink 16 and is movable between opened and closed positions to cover the open top of the second bowl 18 as shown in FIG. 1.

The second bowl 20 is formed by a peripheral wall 34 and a bottom wall 36. The peripheral wall 34 extends upwardly and away from the bottom wall 36 and terminates in a peripheral lip 37 disposed slightly below the peripheral flange 24, preferably such a distance that when the lid 32 is resting on the lip 37 in the closed position, the upper surface of the lid is approximately level with the peripheral flange 24.

Conceptually, the peripherally lip can be thought of as a step portion associated with either the wall 36 or the peripheral flange 24. While shown as extending around the bowl 20, the peripheral lip 37 can extend along just one side or a part of one side of the bowl or on multiple sides, as desired. In the preferred embodiment, the lip 37 is peripheral and provides a support surface for the lid that enables the top of the lid to be flush with the peripheral flange 24 when the lid is closed.

A drain 38 is provided in the bottom wall 36. A self-aligning puppet valve 40 also is located in the bottom wall 36. Preferably, the self-aligning puppet valve 40 is centered in the bottom wall since the puppet valve 40 forms one part of a liquid coupling for supplying liquid to the wash chamber 30 when the second bowl 20 is used as an in-sink dishwasher.

A latch comprising a strike 39 and catch 41 are provided for holding the lid in the closed position. The strike 39 is preferably mounted to the lid 32 and the catch 41 is mounted to the sink and located in the lip 37.

Figure 4:
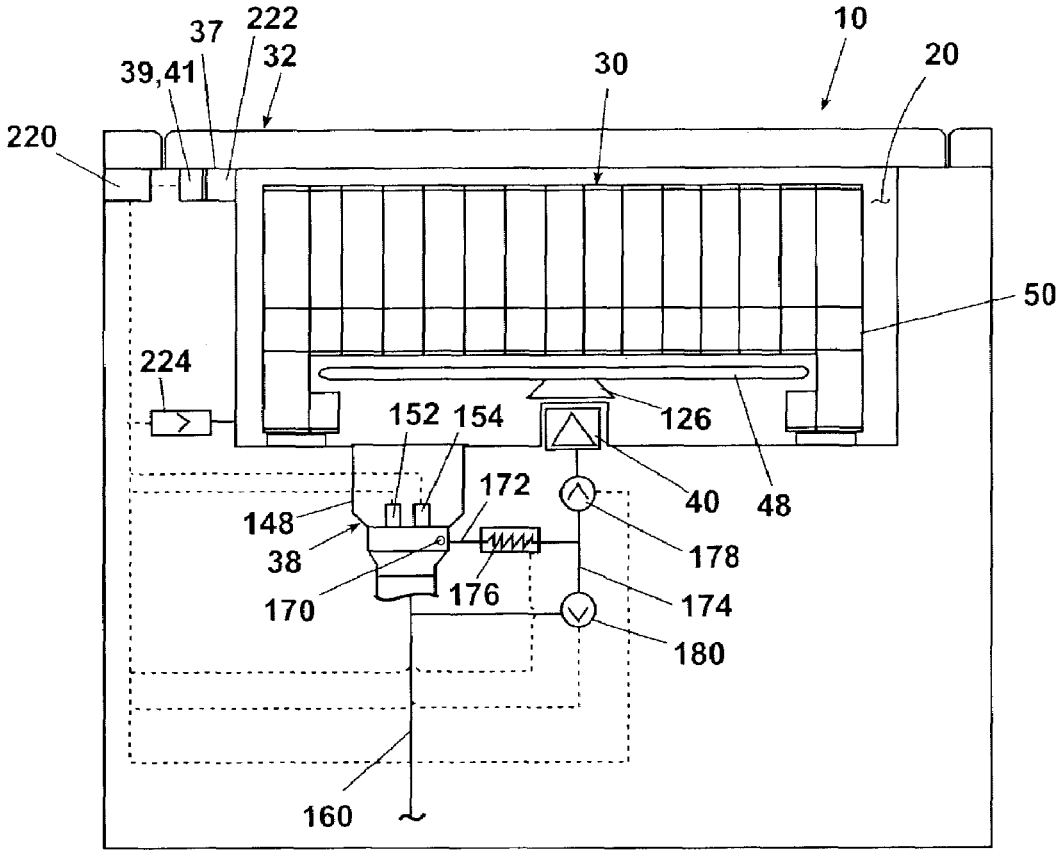
FIG. 4 is a schematic illustration of the liquid-handling components of the in-sink dishwasher and their functional interaction with the sink.

Referring to FIG. 3 specifically and FIG. 4 generally, the major components of the in-sink dishwasher comprise a bottom screen 42, drain filter 44, drain plug 46, spray arm assembly 48, and dish basket 50. The bottom screen 42 is preferably formed of a thin metal material, such as stainless steel, in which is formed a series of perforations or holes 54. A downwardly extending annular flange 56 is provided in the bottom screen 42 and defines a drain opening 58, which aligns with the drain 38 when the bottom screen 42 is mounted to the bottom wall 36. A recess 60 is formed on one side of the bottom screen 42 and is sized to receive the puppet valve 40 when the bottom screen 42 is positioned against the bottom wall 36.

The spray arm assembly 48 comprises a hollow spray arm 114, preferably made from stainless steel, with a liquid inlet 116 formed in a lower surface and spray outlets 117 formed on an upper surface. A mounting bracket 118 is secured to the upper surface of the spray arm 114 and includes resilient hooks 120 for snap-fitting with the basket 50 and a rotatable coupling 122 that rotatably mounts the spray arm 114 to the resilient hooks 120. Thus, the mounting bracket 118 provides for the snap-fit mounting of the spray arm 114 to the basket while permitting the spray arm 114 to rotate relative to the basket 50. A deflector 126 is mounted to the lower surface of the spray arm 114 and circumscribes the puppet valve 40 when the basket is seated in the wash chamber 20 to fluidly couple the puppet valve 40 to the spray arm 114.

The basket 50 is made from multiple coated wires in a well-known manner and will not be described in great detail. The basket includes multiple peripheral wires 136, forming the outer periphery of the basket side wall and multiple U-shaped wires 138 laterally spanning the peripheral wires 136 to form the basic basket shape. Feet 140 are formed by wires extending from the side of the basket. The feet 140 are preferably L-shaped and extend below the bottom of the basket so that the bottom of the basket will be spaced from the bottom wall of the sink when the feet touch the bottom wall.

Referring to FIG. 4 specifically and FIG. 3 generally, the fluid control system for the in-sink dishwasher is generally described. The drain 38 is preferably made from plastic and includes a sump 148. A temperature sensor 152, preferably in the form of a thermistor, and a liquid level sensor 154, preferably in the form of a dome-type pressure sensor, are located in the sump 148. The drain 38 further includes a waste drain 160 extending from the sump 148 and is adapted to be connected to a household water drain.

A recirculation inlet 170 is formed in the side wall of the sump 148 below the lugs and above the annular sealing surface. A recirculation inlet 170 is connected to the puppet valve 40 by a liquid conduit 172. The recirculation inlet 170 permits liquid flow in the sump 148 to be directed through the conduit 172 to the puppet valve 40 and into the spray arm 114, when the basket 50 is seated within the second bowl 20 to establish a recirculation loop where liquid can be continuously recirculated from the sump and onto the dishes contained in the basket 50.

A recirculation drain 174 is fluidly connected to the waste drain 160 below the location where the plug seats. The recirculation drain 174 is also fluidly connected to the conduit 172. The fluid connection of the recirculation drain 174 between the waste drain 160 and the liquid conduit 172 permits the draining of the liquid in the recirculation loop even when the drain plug 46 has closed off the waste drain 160.

An in-line liquid heater 176 and a recirculation pump 178 are fluidly connected to the liquid conduit 172 and form part of the recirculation loop. The in-line water heater 176 is used to receive liquid passing through the conduit 172 and the recirculation pump 178 pumps liquid through the recirculation loop.

A drain pump 180 is also fluidly connected to the liquid conduit 172 as well as to the recirculation drain 174. The drain pump 180 permits the liquid in the recirculation loop to be drained from the wash chamber through the sump when the drain plug 46 has closed the waste drain 160.

The recirculation pump 178 and drain pump 180 act both as a valve and a pump since when the pumps are turned off, water cannot pass through the pump. Therefore, both pumps can be coupled to the liquid conduit 172 without interfering with the flow of liquid through the recirculation loop or the draining of liquid from the recirculation loop. It is possible for a single pump with multiple outlets to be used in place of separate recirculation in-drain pumps.

A controller 220, preferably a microprocessor-based controller, controls the operation of the in-sink dishwasher. The controller is electrically coupled to the in-line heater 176, recirculation pump 178, drain pump 180, user interface 222, inlet valve 224, liquid level sensor 154, and temperature sensor 152 to control their respective operations. The controller is also connected to a sensor (not shown) indicating whether the lid is latched. These types of sensors are well known in the art and are generally part of the strike 39 or catch 41.

The controller 220 controls the operation of a wash cycle and preferably has multiple pre-programmed wash cycles, which correspond to the cycles shown on the user interface 222. The pre-programmed cycles are stored within the memory of the controller.

There are many well-known wash cycles in addition to the previously described cycles and the invention is not limited to a particular cycle. The wash cycles typically comprise multiple steps, the building blocks of which include introducing and recirculating a charge of water into the wash chamber. Some steps can include the addition of a detergent. Other steps might include heating the water as in the case of the SANE-RINSE. The exact cycles and steps are not germane to the current invention other than the controller 220 for the in-sink dish washer is capable of performing one or more wash cycles.

Figure 5:
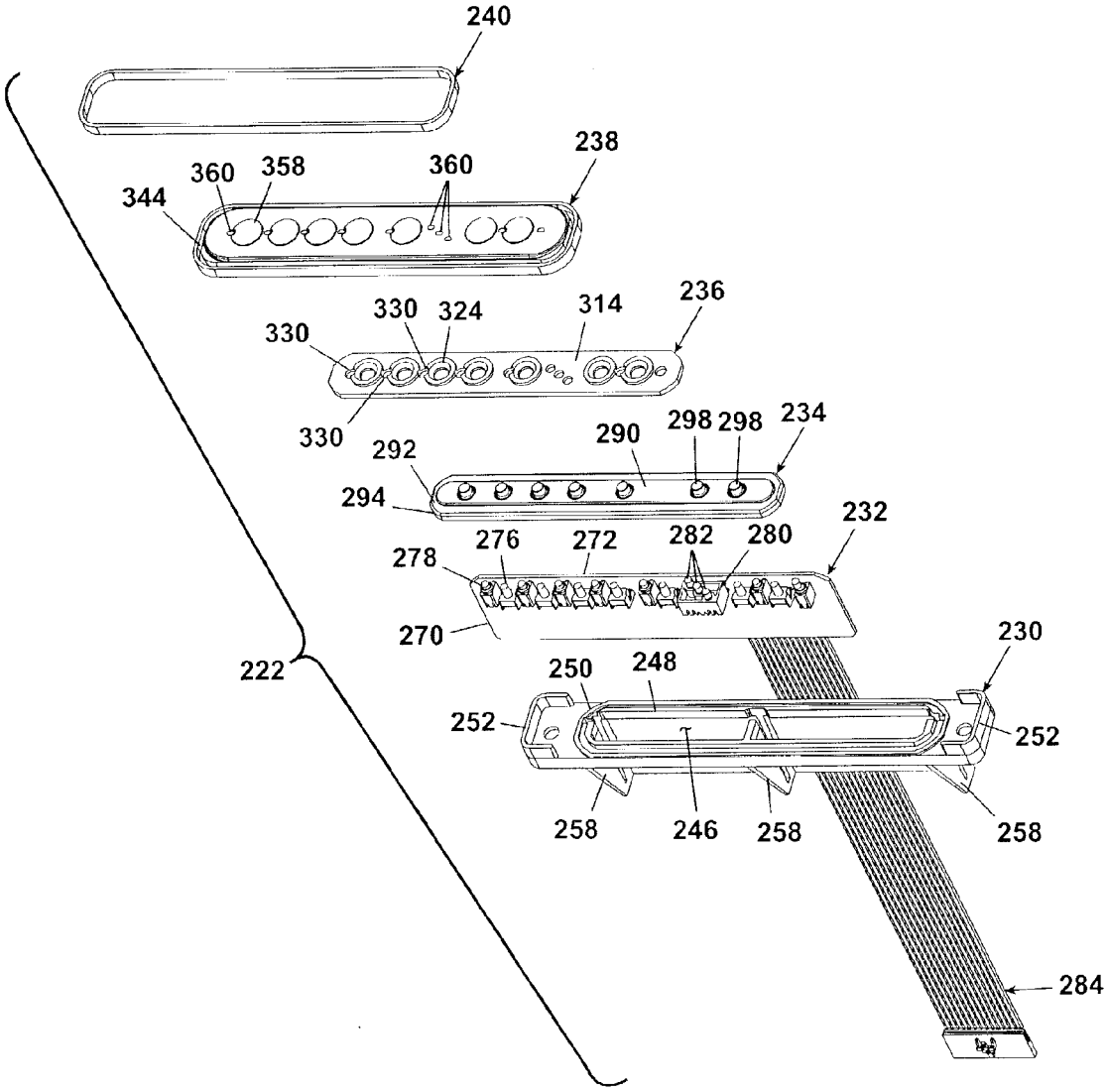
FIG. 5 is an exploded perspective view of the user interface according to the invention and disclosing an interface board mounted in a bracket, with a spacer separating the interface board from a backing plate that supports a cover plate, which is sealed by a gasket to the sink.
Figure 6:
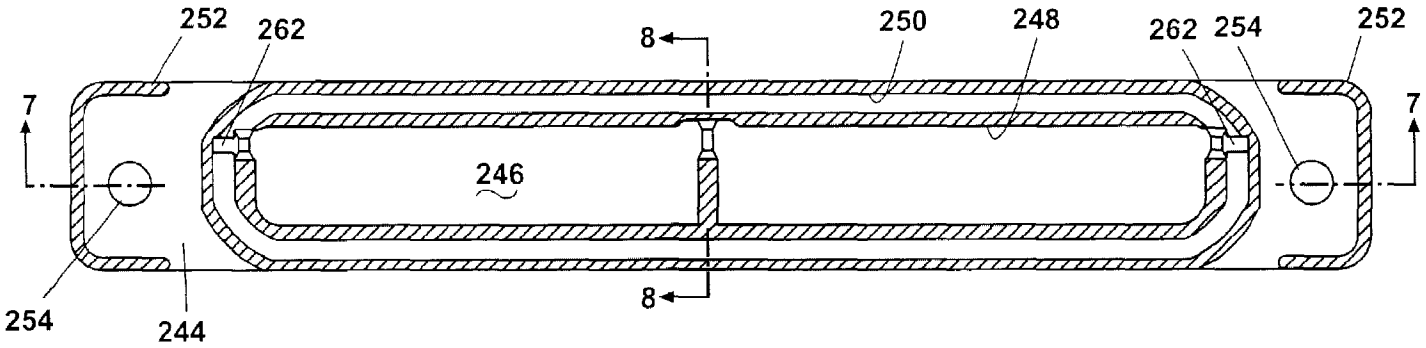
FIG. 6 is a top view of the bracket shown in FIG. 5.
Figure 7:
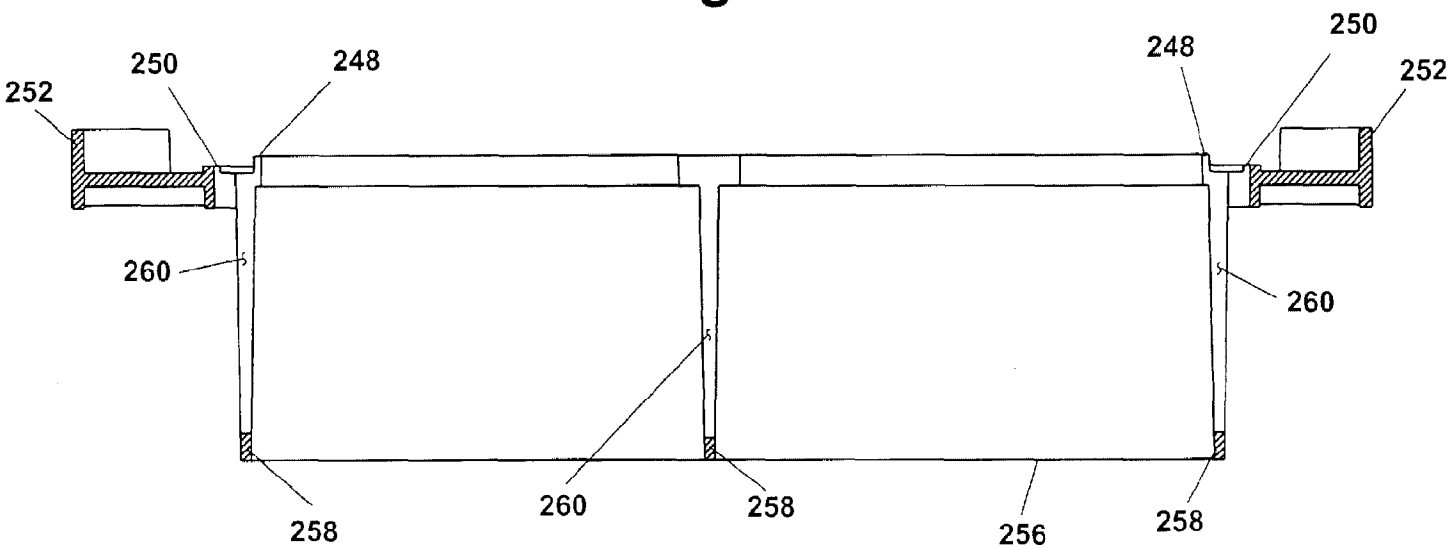
FIG. 7 is a sectional view of the bracket taken along line 7—7 of FIG. 6.
Figure 8:
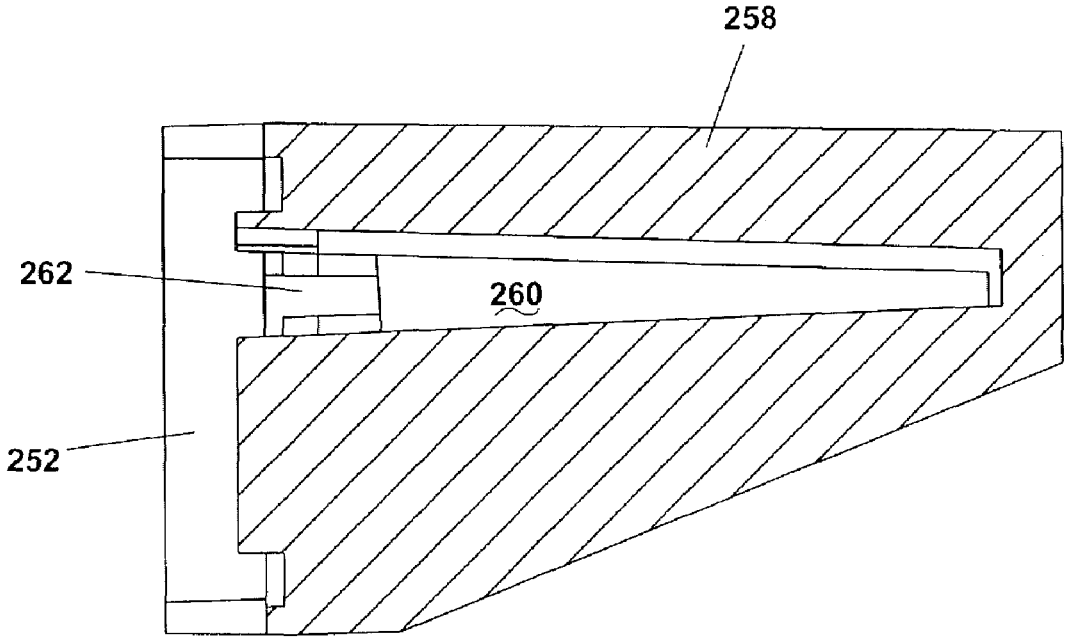
FIG. 8 is a sectional view taken along line 8—8 of FIG. 6.
Figure 9:
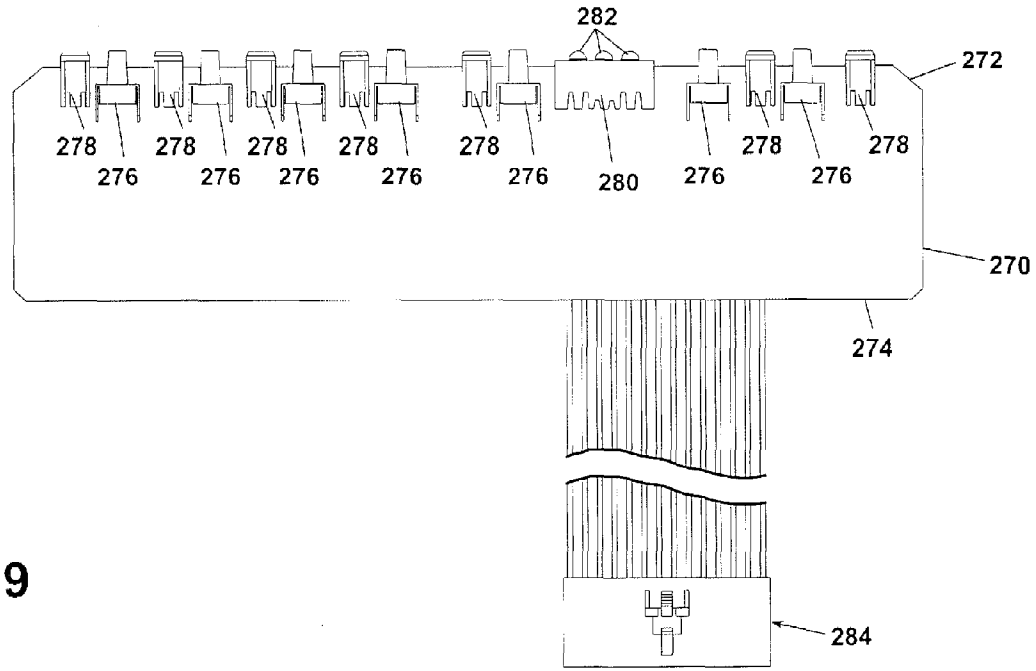
FIG. 9 is a front view of the interface board shown in FIG. 5.
Figure 10:
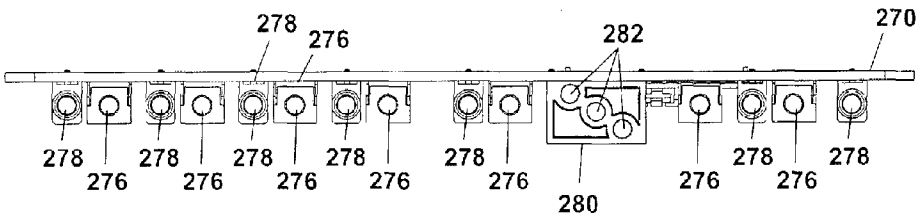
FIG. 10 is a top view of the interface board shown in FIG. 5.
Figure 11:
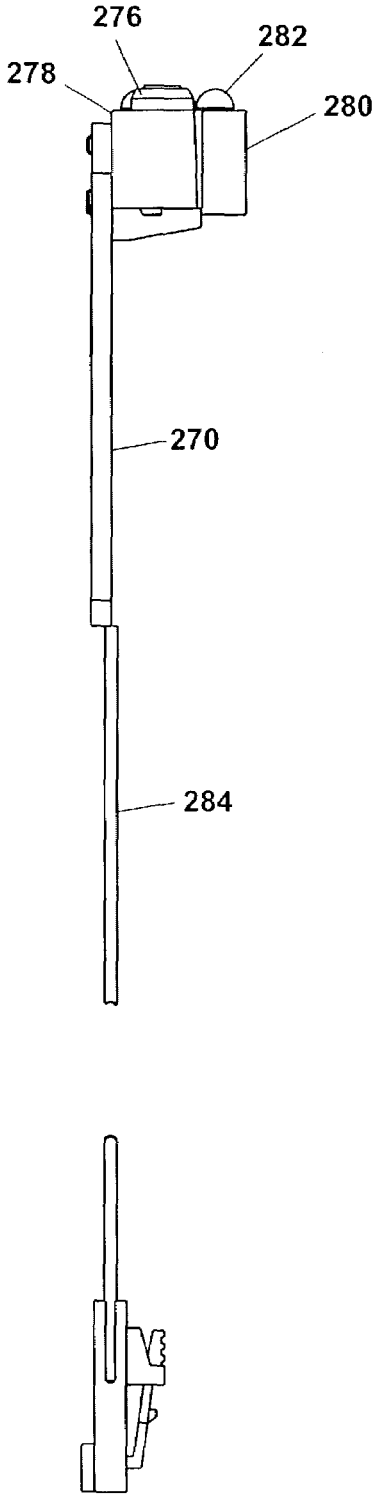
FIG. 11 is a end view of the interface board shown in FIG. 5.
Figure 12:
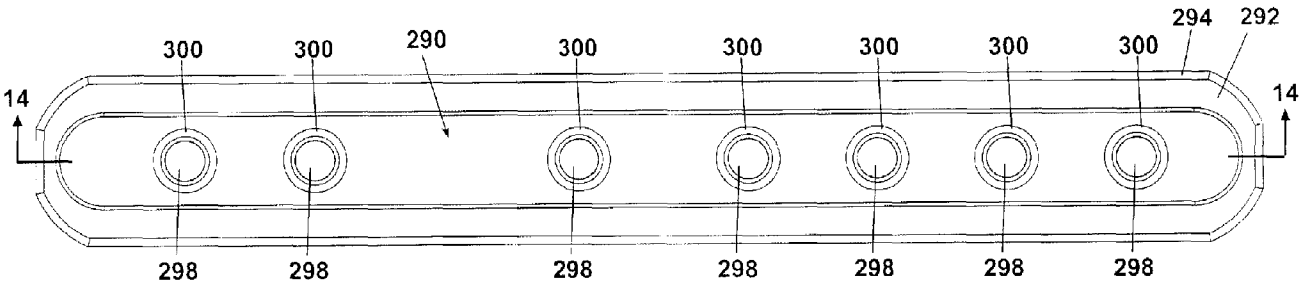
FIG. 12 is a top view of the spacer shown in FIG. 5.
Figure 13:
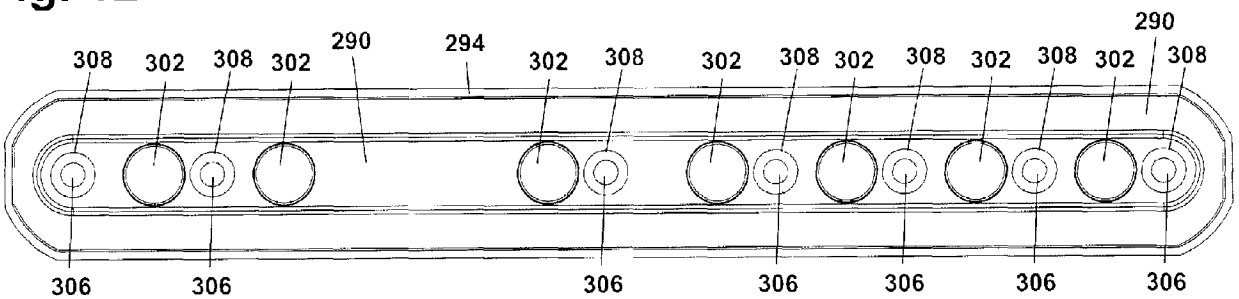
FIG. 13 as a bottom view of the spacer shown in FIG. 5.
Figure 14:
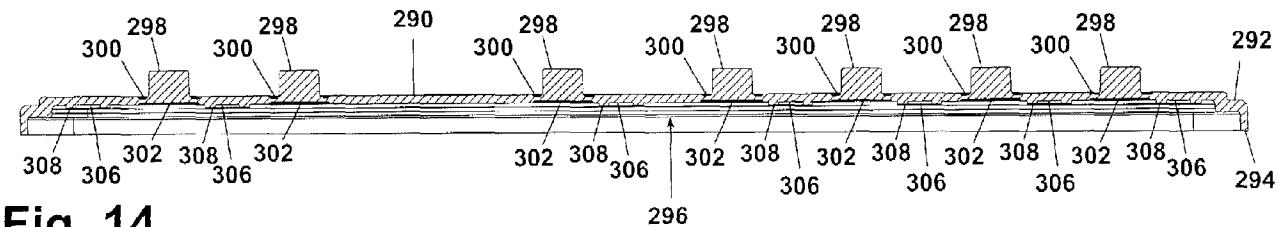
FIG. 14 is a longitudinal sectional view of the spacer taken along line 14—14 of FIG. 12.
Figure 15:
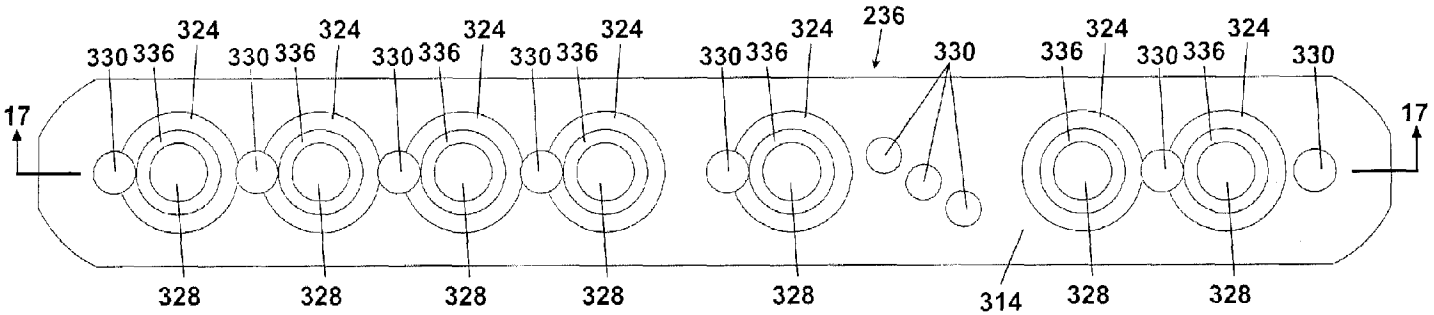
FIG. 15 is a top view of the backing plate shown in FIG. 5.
Figure 16:
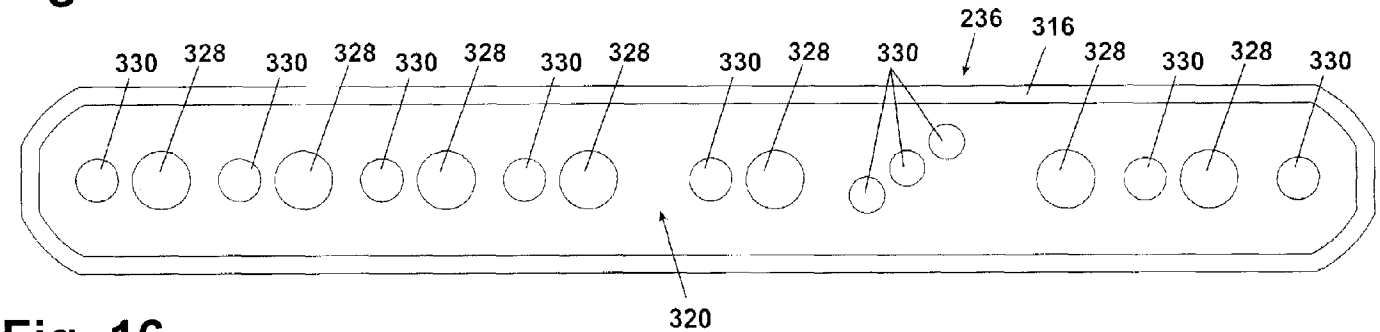
FIG. 16 is a bottom view of the backing plate shown in FIG. 5.
Figure 17:
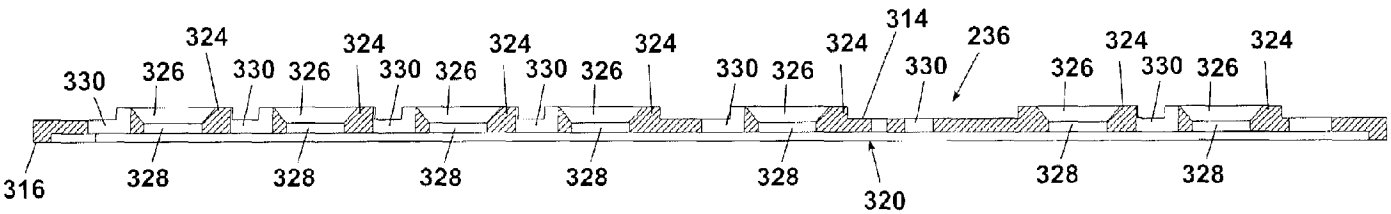
FIG. 17 is a longitudinal sectional view of the backing plate taken along line 17—17 of FIG. 15.
Figure 18:
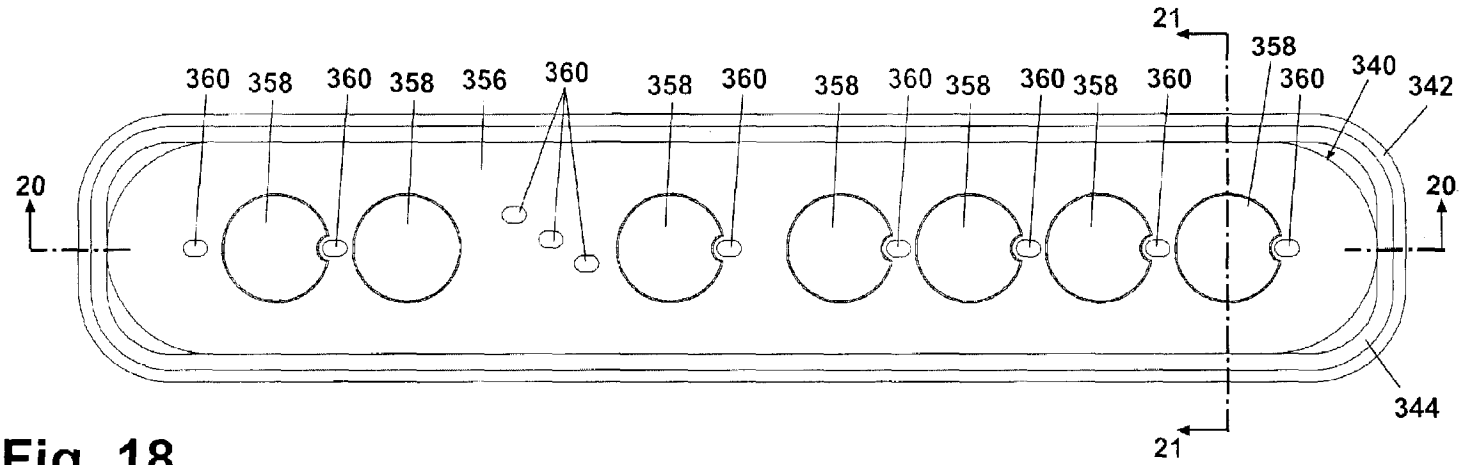
FIG. 18 is a top view of the cover plate shown in FIG. 5 and showing a cover template.
Figure 19:
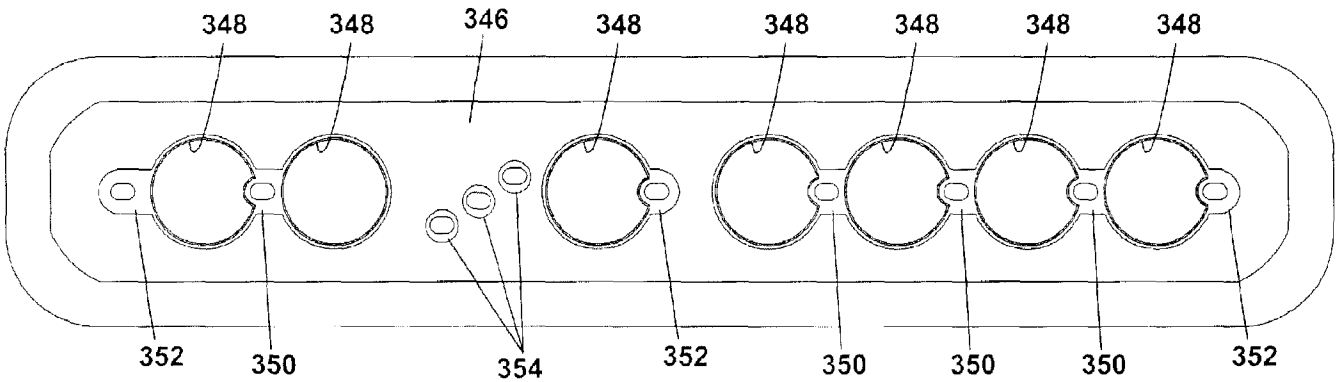
FIG. 19 is a bottom view of the cover plate shown in FIG. 5.
Figure 20:
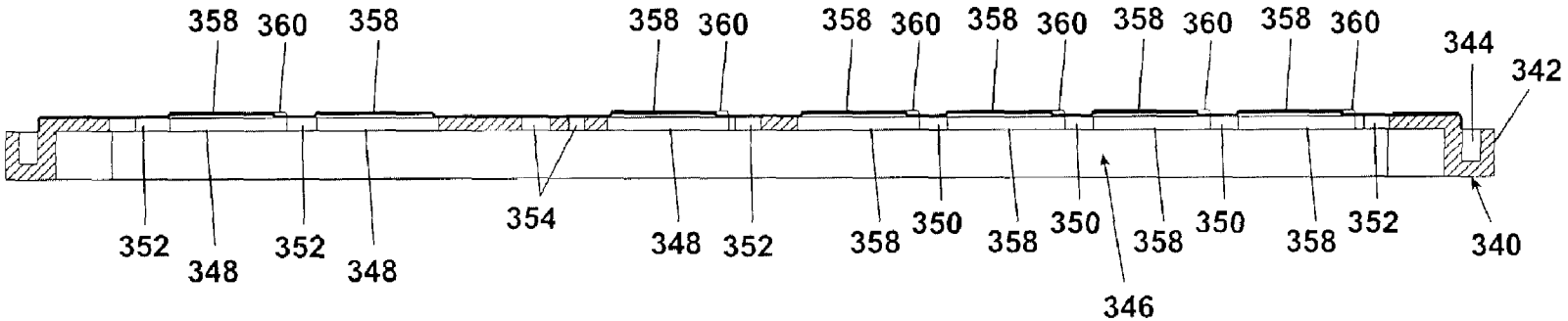
FIG. 20 is a longitudinal sectional view of the cover plate taken along line 20—20 of FIG. 18.
Figure 21:
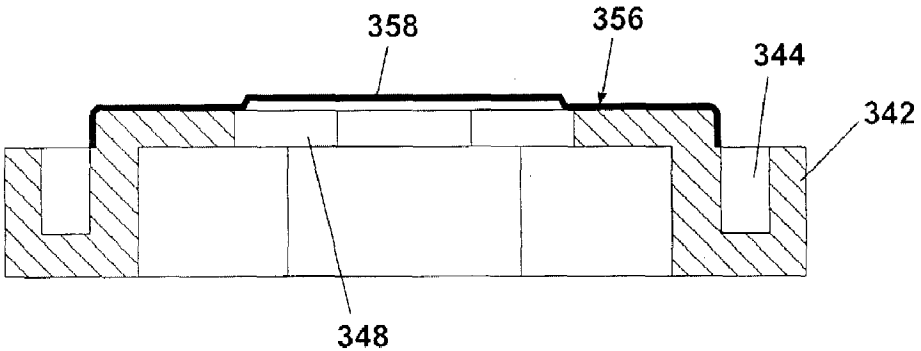
FIG. 21 is a transverse sectional view of the cover plate taken along line 21—21 of FIG. 18.

FIG. 5 illustrates the user interface 222 in greater detail. The user interface 222 comprises a mounting bracket 230 that supports an interface or circuit board 232. The bracket mounts to the sink to support the user interface relative to the sink. A spacer 234 spaces a backing plate 236 that supports a cover plate 238 relative to the interface board 232. The spacer 234 also functions as a seal to seal the interface board 232 relative to the bracket. A gasket 240 seals the cover plate 238 with respect to the peripheral lip 37 of the sink. Since the cover plate 238 is preferably in contact with the bracket 230, the gasket effectively functions as a second seal between the interface board and the sink.

Referring to FIGS. 5–8, the mounting bracket 230 comprises a base 244, which defines a face for the bracket 230 having a generally planar surface, and in which is formed a central opening 246 that is bounded by an oval-shaped rib 248. A second oval-shaped rib 250 circumscribes the oval-shaped rib 248. The rib 248 can be thought of as the inner rib and the rib 250 can be thought of as the outer rib. The concentric ribs 248, 250 define a channel therebetween. C-shaped stops 252 are located at the opposite ends of the base 244. Fastener openings 254 extend through the base 244 at a location between the stops 252 and the outer rib 250.

A back wall 256 defining a side to the bracket extends away from the base 244 and is located along an outer edge of the base 244. Multiple support legs 258 extend between the back wall 256 and the base 244. A slot 260 is formed in each of the support legs. Each of the slots 260 has an open top located at the base 244. Openings 262 are located in the base 244 and align with the open tops of the slots 264 of the outermost legs 258. The slots 260, in combination with the openings 262, collectively form a slot in which the interface board 232 is slidably received.

Referring to FIGS. 5 and 9–11, the interface board 232 comprises a circuit board 270 having a generally planar shape with an upper edge 272 and a lower edge 274. A series of switches 276 and lights 278 are arranged along the upper edge 272 of the circuit board 270. A light array 280 is also located along the upper edge 272 of the circuit board 270. The light array 280 comprises multiple lights 282. The lights 278, 282 are preferably in the form of a light-emitting diode (LED). A ribbon connector 284 extends from the lower edge 274 of the circuit board 270 and provides for all the electrical connections on the circuit board 272 of the controller 220. It is within the scope of the invention for the controller 220 to be located on the circuit board 270, negating the need for the ribbon connector.

Referring to FIGS. 5 and 12–14, the spacer 234 is shown in greater detail. The spacer 234 is preferably a membrane made from silicon or any other suitable material that can perform a sealing function along with being elastic to permit the flexing and/or compression of the spacer 234. The spacer 234 overlies the switches 276 and seals the switches 276 along with the circuit board 270 relative to the bracket.

The spacer 234 has a central elongated base 290 that is circumscribed by a shoulder 292 and from which extends a peripheral lip 294, which defines a recess 296 on one side of the base 290, for receiving the upper edge 272 of the circuit board 270. A series of actuators 298 are integrally formed with the base 290 and extend away from the base 290 in a direction opposite the recess 296. Each of the actuators 298 corresponds to a switch 276 on the circuit board 270 such that the depression of the actuators 298 will result in the actuation of the corresponding switch 276 when the user interface is assembled.

An annular depression 300 in the upper surface of the base 290 circumscribes each actuator 298. A recess 302 is formed in the lower surface of the base 290. The recess 302 overlaps the annular depression 300 and forms a reduced thickness portion that circumscribes each of the actuators 298, which aids in moving the actuators 298 relative to the base 290.

A series of lighting recesses 306 are located on the base 290. The lighting recesses are formed by annular rings 308 that extend from the lower surface of the base 290. The lighting recesses 306 correspond to the lights 278. The annular ring 308 helps in positioning the lights 278 within the recess 306.

The spacer is preferably made from a material having an opacity that permits the light emitted by the light sources on the circuit board to pass through the spacer. The light-transmissive nature of the spacer can be translucent or transparent.

Referring to FIGS. 5 and 15–17, the backing plate 236 comprises a base 314 circumscribed by a peripheral rim 316, which extends below the lower surface of the base 314 and defines a recess 320, which is sized to receive the spacer 234.

A series of chamfered openings 324 are formed in the base 314 and extend therethrough to the recess 320. Each of the chamfered openings 324 comprises an outer bevel portion 326 that circumscribes a through opening 328. The chamfered openings 324 correspond to the actuators 298 of the spacer 234 and the through openings 328 are sized to receive the actuators 298.

A series of light openings 330 are located adjacent the chamfered openings 324. The light openings 330 correspond to the light recesses 306 of the spacer 234. Light openings 330 are also provided for the lights 282 of the light array 280.

Referring to FIGS. 5 and 18–21, the cover plate 238 is shown in greater detail. The cover plate 238 comprises a base 340 circumscribed by a rim 342, which defines a channel 344 therebetween. The channel 344 is sized to receive the gasket 240. The rim 342 extends below the base 340 to form a recess 346, which is sized to receive the base 314 of the backing plate 236.

A series of button openings 348 extends through the base 340 and into the recess 346. Some of the adjacent button openings 348 are connected by channels 350. Partial oval-shaped openings 352 are provided for some of the button openings 348. Oval-shaped light openings 354 extend through the base 340.

The button openings 348 correspond to the chamfered openings 324 of the backing plate 236. The channel 350 and the partial oval-shaped openings 352 correspond to the light openings 330 of the backing plate 236. The oval-shaped light openings 354 correspond to the light openings 330 of the backing plate 236 for the light array 280.

A template 356 is over molded onto the base 340 and comprises a series of raised buttons 358, which correspond to the button openings 348. The template 356 further comprises a series of transparent or translucent windows 360, which correspond to the partial oval-shaped openings 352 and/or the oval-shaped light openings 354. The windows 360 can be colored such that any light passing through the windows will be similarly colored. The selected color will normally correspond to colors indicative of certain standard operational statuses. For example, red can be used to indicate the abnormal stopping of a cycle and green can be used to indicate the normal completion of a cycle.

The template 356 is typically printed with indica that aid the user in selecting various operational features of the in-sink dishwasher or inputting various operational parameters. The template 356 can also be made from a compressible material to enhance the quality of the feel to the end user. Additionally, although not shown, the template can be sized such that it abuts the edge of the opening in the peripheral flange to form yet another seal between the user interface and the sink.

Figure 22:
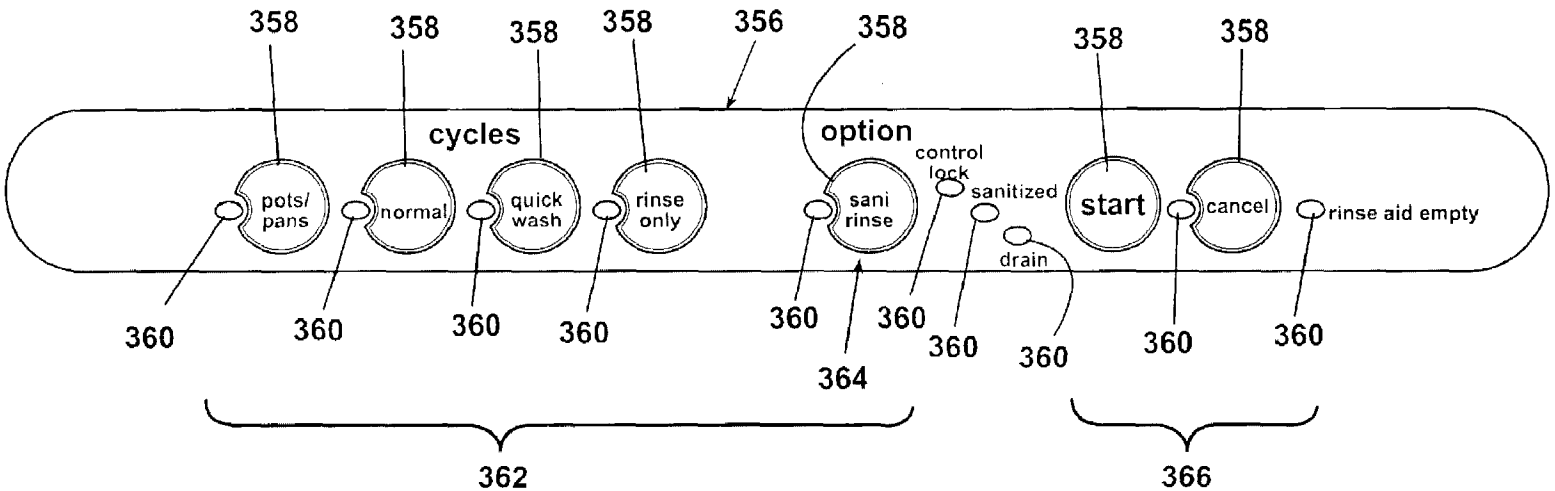
FIG. 22 is a close-up top view of the template with the preferred indica.

FIG. 22 illustrates a preferred template 356 for the user interface 222. The selection buttons 358 are grouped according to their corresponding function. For example, the buttons identified by numeral 362 correspond to wash cycles, such as POTS/PANS, NORMAL, QUICK WASH, and RINSE ONLY, respectively. Button 364 corresponds to an OPTION, such as SANE-RINSE, which includes a high-temperature rinse. Although only one option button is shown, more than one can be provided. The button group identified by numeral 366 relates to the general operational status of the in-sink dishwasher, identifies the START and CANCEL functions, respectively, and has a single window 360.

The windows 360 adjacent button 358 function as an indicator for that button when light is passed through the window. The windows 360 disposed between the option selection button group 364 and the operation button group 366 are used for status indicators for indicating any desired status of the in-sink dishwasher. Examples of common operational status are CONTROL LOCK, SANITIZED, DRAIN. A window 360 is provided adjacent the CANCEL button and indicates that the rinse aid reservoir is empty. The status light can be located anywhere on the user interface and can indicate any desired status.

Figure 23:
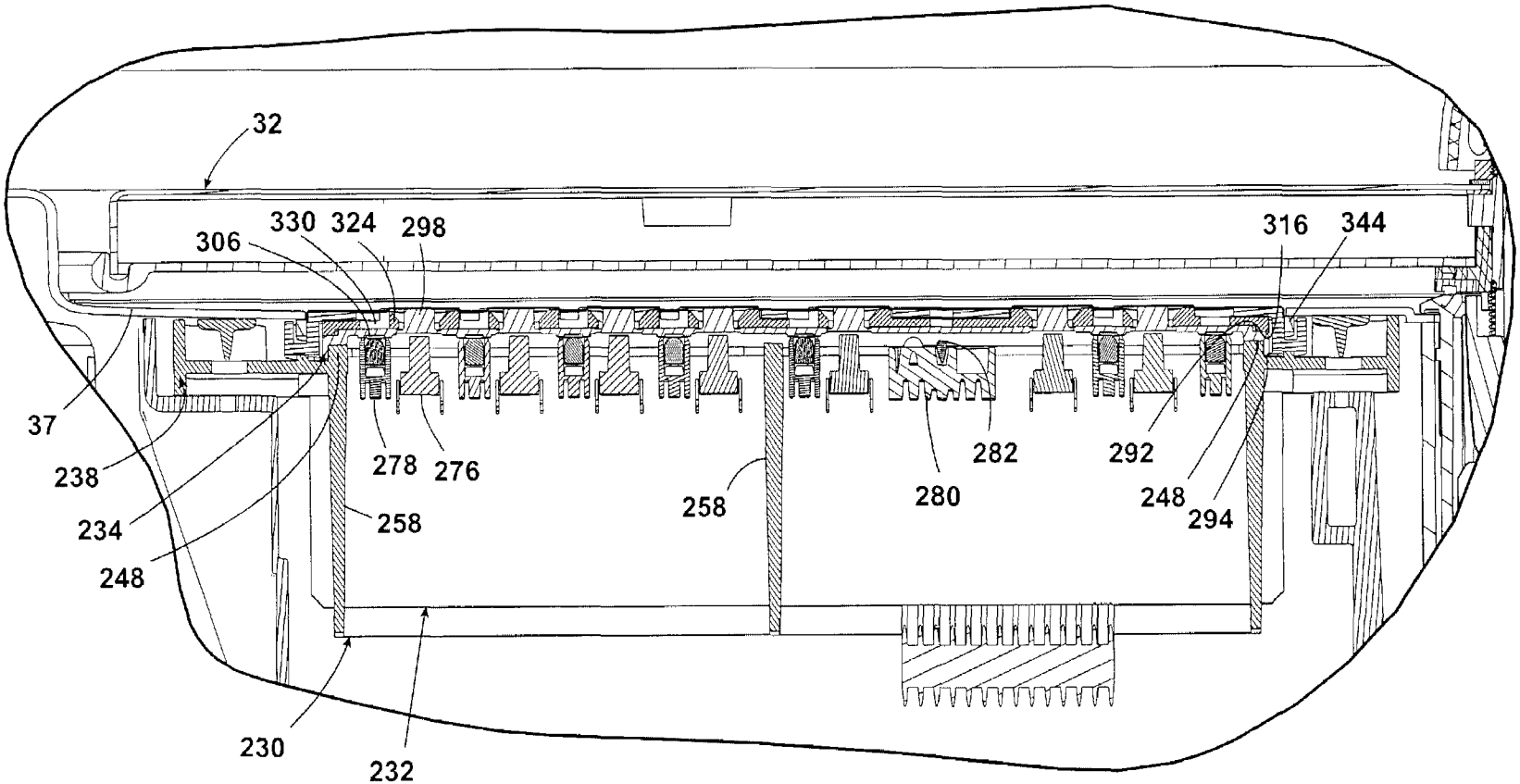
FIG. 23 is a longitudinal sectional view of the assembled user interface when mounted to the sink.

Referring to FIGS. 5 and 23, to assemble the user interface 222, the interface board 232 is first mounted to the mounting bracket 230 by inserting the circuit board 270 into the channel formed by the slots 260 and the openings 262, while ensuring that the ribbon connector 284 extends through the central opening 246. The spacer 234 is then positioned such that it overlies the circuit board 270 and the actuators 298 and light recesses 306 align with the switches 276 and lights 278, 282, respectively. The spacer 234 is then brought into abutting contact with the bracket 230 such that the shoulder 292 of the spacer 234 abuts the inner rib 248 of the base 244 and the plate 294 of the spacer 234 is received in the channel formed between the inner and outer ribs 248, 250 to thereby seal the circuit board relative to the bracket.

The backing plate 236 is then positioned on top of the spacer 234 such that the chamfered openings 324 of the backing plate 236 receive the actuators 298 of the spacer 234, which necessarily align the openings 328 of the backing plate 236 with the light recesses 306 of the spacer. Thus, any light emitted by the lights 278 and 282 will pass through the corresponding light recesses 306-and will be directed through the light openings 330. When the backing plate 236 is assembled onto the spacer 234, the actuators 298 extend through the chamfered openings 324 and slightly beyond the upper edge of the chamfered openings. The rim 316 of the backing plate abuts the shoulder 292 of the spacer and compresses the spacer against the inner rib 248.

The cover plate 238 is then assembled to the backing plate 236 by aligning the cover plate 238 with respect to the backing plate 236 such that the button openings 348 are aligned with the actuators 298, which necessarily align the channel 350, partial oval-shaped openings 352, and oval-shaped light openings 354 with the corresponding light openings 330. As the cover plate 238 is mounted to the backing plate 236, the backing plate 236 is received within the recess 346 of the cover plate.

Figure 24:
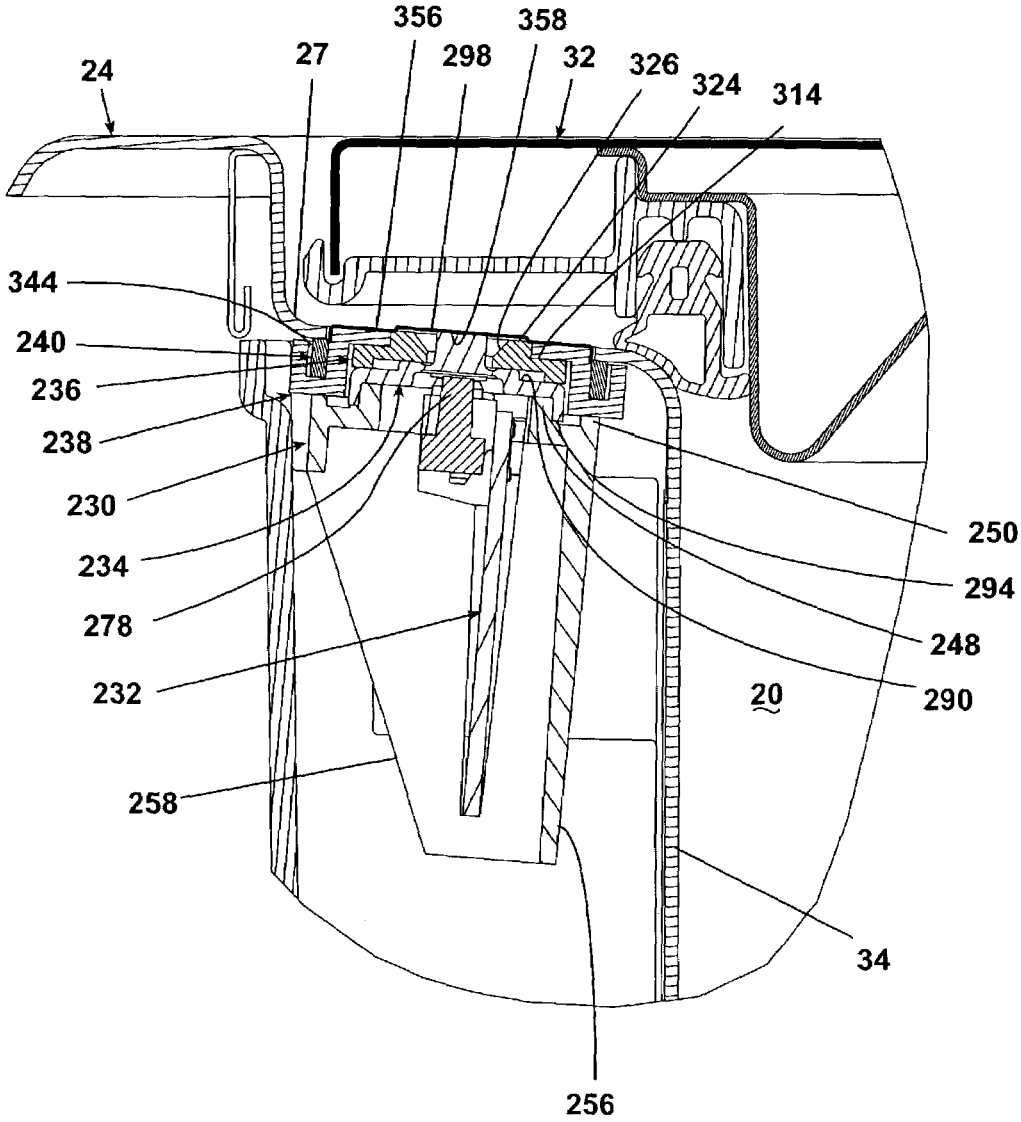
FIG. 24 is a transverse sectional view of the assembled user interface when mounted to the sink.

As best seen in FIGS. 23 and 24, the assembly necessarily aligns the switches 276 with the actuators 298 of the spacer 234, which are positioned beneath the raised buttons 358 of the template 356. Thus, the depression of the raised buttons 358 on the template 356 will result in the corresponding depression of the switches 276. The reduced cross-sectional area surrounding the actuators 298 formed by the annular depression 300 and recess 300 increases the ability of the actuators 298 to move relative to the base 298 of the spacer 234.

The lights 278 and 282 are aligned with the light recess 306, light openings 330, and the windows 360 on the template 356. The alignment provides for any light emitted by the lights 278 and 282 to be seen through the corresponding window 360.

The assembly is completed by inserting the gasket 240 into the channel 344 of the cover plate 238. Once the gasket 240 is inserted within the channel 344, the bracket 230 is mounted to the peripheral lip 37 of the sink by fasteners (not shown) extending through the aligned fastener openings 254 of the bracket 230 and 332 of the backing plate 236 and into a corresponding fastener mounted on the sink. The assembled user interface is mounted to the sink such that the base 340 is aligned with a corresponding opening in the peripheral lip. The tightening of the fastener draws the bracket 230 towards the peripheral lip of the sink, thereby compressing the gasket 240 against the peripheral lip to form a seal between the peripheral lip and the cover plate 238.

The seal between the peripheral lip and the cover plate 238 formed by the compression of the gasket 240 is enhanced by the template 356 being made from a water-impermeable material and over-molded onto the base 340. The water-impermeable nature of the template 356 prevents any water contacting the template 356 from passing through to the backing plate 236. The over-molding of the template 356 onto the base 340 results in the edge of the template 356 not being exposed above the peripheral lip, thereby reducing the tendency of any water to migrate between the template 356 and the base 340 and passing onto the backing plate 236. The gasket 240 is also in contact with the side of the template 356 and also serves to seal the template 356 with respect to the peripheral lip of the sink in addition to the seal obtained by over molding.

Another seal is formed between the backing plate 236 and the spacer 234. Rim 316 of the backing plate 236 bears against the shoulder 292 of the spacer 234 and compresses the spacer between the rim 322 and the outer rib 258 of the mounting bracket 230. The combination of the chamfered openings 326 and the actuators 298 effectively block a knife or other sharp instrument that might puncture the template from reaching the circuit board. The chamfered openings 326 and the actuators 298 are sized such that when the actuators 298 are received through the chamfered openings 326, there is not sufficient room for the knife, loaded with a predetermined force, to pass through the spacer and reach the circuit board.

The spacer 234 is preferably made from a compressible and flexible material such as silicon. The advantage of making the spacer from a flexible and compressible material is that the spacer can accommodate the multiple tolerance variances associated with all of the parts comprising the user interface 222. Therefore, it is desirable that the spacer is of sufficient thickness and has sufficient compressibility to accommodate the anticipated tolerance variations in the several parts.

It is within the scope of the invention for the template 356 to be integrally formed with the cover plate 238, backing plate 236, and/or spacer 234. In other words, the indica on the template 356 can be located or incorporated with the cover plate 238, backing plate 236, or spacer 234. Of course, some of the functionality of the invention will be lost in doing so. For example, if the indica is located directly on the cover plate 238, the actuators 298 of the openings 348 in the cover plate will be exposed, increasing the likelihood that liquid can flow onto the spacer 234 through the openings 348 to bypass the seal formed by the gasket.

Another possible alteration is that the indica be placed directly on the spacer 234. If so, it would be possible to completely eliminate the cover plate 238 and backing plate 236 and the spacer 234 would seal against both the lip 237 and the bracket 230. It is possible that the spacer 234 could be used in combination with the gasket 240. However, since the spacer 234 is preferably made from a compressible material, the gasket would most likely not be needed. If the cover plate 238 and backing plate 236 are not used, the user interface would not necessarily have the knife safety feature provided by the combination of the chamfered openings and actuators.

It is also possible that the cover plate and the backing plate can be combined. In such a configuration, the chamfered opening would be formed integrally with the cover plate. This would, however, make it more difficult to over-fold the template on the cover plate 236.

To perform a wash cycle, the user selects the desired cycle by depressing the corresponding button 358 of the cycle group 362. The user then selects an option desired by depressing the option button 358 of the option group 364. After selecting the cycle and the corresponding options, the user selects the START button and the controller 220 implements the selected cycle, along with the selected options, if any. The user can terminate the selected cycle by depressing the CANCEL button.

Once the lid 32 is closed after the selection of the cycle, options, and the depression of the START button, the controller 220 implements the selected cycle by operating the in-line heater 176, recirculation pump 178, drain pump 180, and inlet valve 224, along with data from the water level sensor 154 and the temperature sensor 152. The controller generally includes an internal clock that handles timing functions and internal counters for any cycle functions. If, for any reason, the lid 32 is opened during the operation of the wash cycle, the controller 220 pauses the cycle, which can then be terminated by depressing the CANCEL button.

Another advantage of the invention is that when the lid is closed, the lid overlies the user interface and protects the buttons 358 from accidental depression. This is especially important in the in-sink dish washer configuration where the lid in the closed position effectively forms an extension of the counter top and provides additional work surface for food preparation. Since the lid is adjacent the water faucet and the first bowl, it is very likely that the lid will become a prime work surface when it is closed, increasing the importance that the user be prevented from accidentally depressing buttons on the user interface during the operation of a wash cycle.

FIGS. 25–29 illustrate an alternative cover plate construction. Since the alternative cover plate structure combines many features of the previously described cover plate and backing plate, like numbers with the prime notation will be used to identify like elements.

Figure 25:
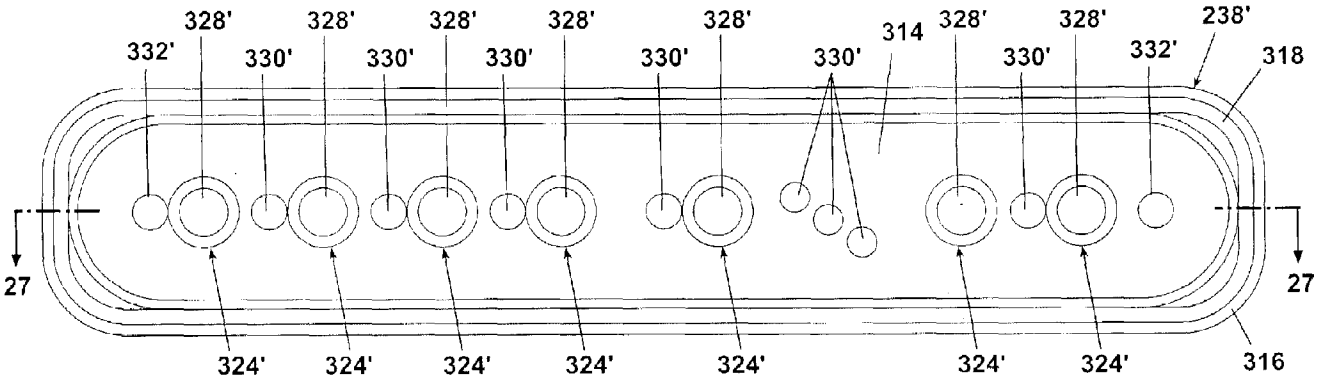
FIG. 25 is a top view of an alternative cover plate.
Figure 26:
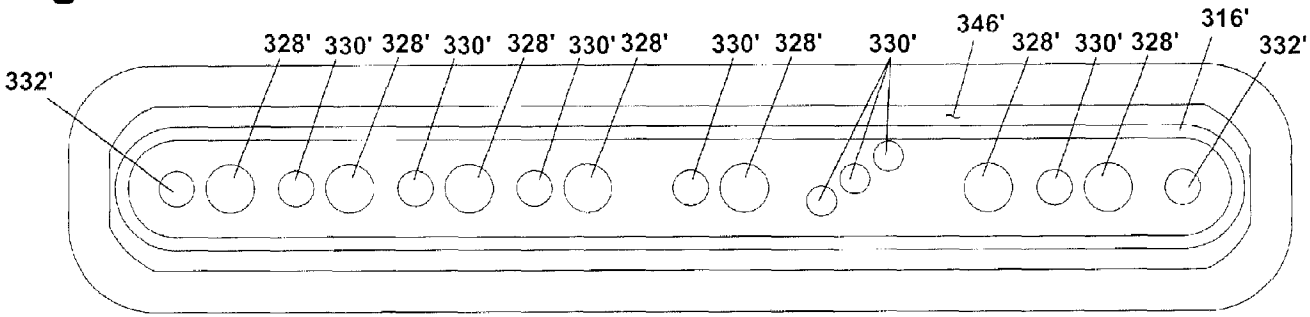
FIG. 26 is a bottom view of the alternative cover plate shown in FIG. 25.
Figure 27:
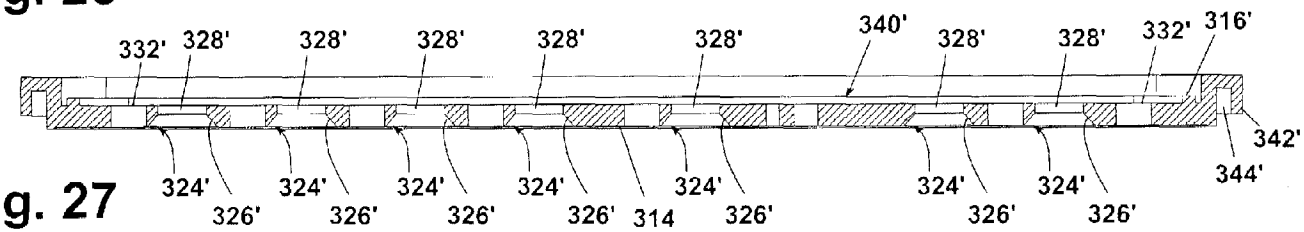
FIG. 27 is a sectional view of the alternative cover plate taken along line 27—27 of FIG. 25.

Referring to FIGS. 25–27, the backing plate 238' comprises a base 340' circumscribed by a peripheral rim 342', which is spaced from the base 340' and defines a peripheral channel 344' therebetween. The peripheral rim 342' extends below the lower surface of the base 340' and defines a recess 346', which is sized to receive the spacer 234. A rim 316' extends from the lower surface of the base 340' and to the recess 346' and has a shape that corresponds to the base 290 of the spacer 234 so that the base 290 of the spacer is received within the recess 346' when the user interface 222 is assembled.

A series of raised chamfered openings 324' is formed in the base 340' and extend therethrough and into the recess 346'. Each of the chamfered openings 324' comprises an outer bevel portion 326' that circumscribes a through opening 328'. The chamfered openings 324' correspond to the actuators 298 of the spacer 234 and the through openings 328' are sized to receive the actuators 298.

A series of light openings 330' is located adjacent the chamfered openings 324'. The light openings 330' correspond to the light recesses 306 of the spacer 234. Light openings 330' are also provided for the lights 282 of the light array 280. Fastener openings 332' are disposed on opposite sides of the base 340' and correspond to the openings 254 in the base 244 of the bracket 230.

Figure 28:
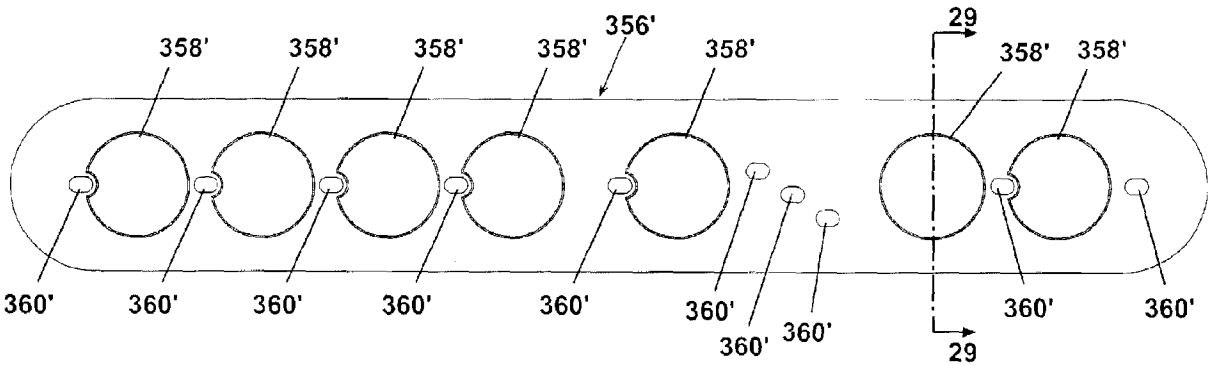
FIG. 28 is a top view of an alternative template to be used in combination with the alternative cover plate shown in FIG. 25.
Figure 29:
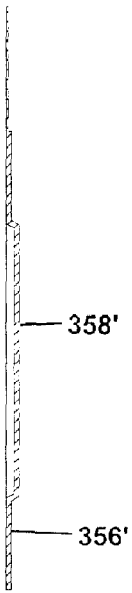
FIG. 29 is a sectional view of the alternative template taken along line 29—29 of FIG. 28.

Referring to FIGS. 28–29, the template 356' is identical to the template 356 except that it is adhered to the base 340 instead of being over molded. The template 356' comprises a series of raised buttons 358', which correspond to the chamfered openings 324'. The template 356' further comprises a series of transparent or translucent windows 360', which correspond to the light openings 330'.

When the template 356' is mounted to the base 340', the buttons 358' and windows 360' align with the chamfered openings 324' and light openings 330', respectively, permitting light to pass from the lights 278, 282, through the spacer, light openings 330', and windows 360'.

While the invention has been specifically described in connection with certain specific embodiments thereof, it is to be understood that this is by way of illustration and not of limitation, and the scope of the appended claims should be construed as broadly as the prior art will permit.

The invention claimed is:

1. An in-sink dishwasher for mounting in a conventional counter top to provide the user with the dual functionality of a sink and a dishwasher, the in-sink dishwasher comprising:

a sink having a bowl defining a wash chamber and terminating in a peripheral flange defining an open top to the wash chamber for receiving dishes to be washed, and the bowl sized to be inserted within an opening in the counter top and the peripheral flange sized to abut the counter top and limit insertion of the bowl;

a lid movably mounted to the sink for movement between an opened position permitting access to the wash chamber through the open top and a closed position where the lid closes the open top;

a faucet located exteriorly of the wash chamber and configured to introduce liquid into the wash chamber when the lid is in the opened position;

a spray arm assembly fluidly connected to the wash chamber and configured to spray liquid in the wash chamber when the lid is in the closed position; and a control system operably coupled to the spray arm assembly for controlling the operation of the dishwasher according to a predetermined wash cycle and comprising a user interface located in the peripheral flange of the sink for selecting the predetermined wash cycle, wherein the in-sink dishwasher can selectively function as a sink by introducing liquid into the wash chamber from the faucet when the lid is open and as a dishwasher when the lid is closed by spraying liquid into the wash chamber from the spray arm assembly in accordance with the predetermined wash cycle.

2. The in-sink dishwasher according to claim 1 wherein the lid is sized such that the lid overlies and covers the user interface when the lid is in the closed position.

3. The in-sink dishwasher according to claim 2 wherein the peripheral flange comprises a step and the user interface is located on the step.

4. The in-sink dishwasher according to claim 3 wherein the peripheral flange comprises a peripheral lip spaced below the remainder of the peripheral flange a sufficient amount such that the lid nests within the peripheral flange when the lid is in the closed position and a portion of the peripheral lip forms the step.

5. The in-sink dishwasher according to claim 3 wherein the step extends along a front side of the bowl.

6. The in-sink dishwasher according to claim 5 wherein an upper surface of the lid is approximately level with the remainder of the peripheral flange when the lid is in the closed position.

7. The in-sink dishwasher according to claim 5 wherein the lid is hingedly mounted to the sink for rotation between the opened and closed positions about a hinge axis extending along a rear side of the bowl.

8. The in-sink dishwasher according to claim 1 wherein the user interface comprises a circuit board having a plurality of switches that are accessible through an opening in the peripheral flange.

9. The in-sink dishwasher according to claim 8 wherein the user interface further comprises a bracket mounted to the sink and to which the circuit board is mounted to thereby mount the circuit board to the sink.

10. The in-sink dishwasher according to claim 9 and further comprising a first seal to seal the circuit board relative to the bracket and a second seal to seal the first seal relative to the peripheral flange.

11. The in-sink dishwasher according to claim 10 wherein the first seal comprises a membrane overlying the plurality of switches and abutting the bracket to seal the circuit board relative to the bracket.

12. The in-sink dishwasher according to claim 11 wherein the membrane has at least one actuator corresponding to one of the switches, whereby the movement of the actuator actuates the corresponding switch.

13. The in-sink dishwasher according to claim 12 wherein the second seal comprises a plate having one surface abutting the membrane and a second surface abutting the peripheral flange to form the seal between the first seal and the peripheral flange.

14. The in-sink dishwasher according to claim 13 wherein the second seal further comprises a gasket positioned between the second surface and the peripheral flange.

15. The in-sink dishwasher according to claim 14 and further comprising a template mounted to the plate and having at least one button that corresponds to the at least one actuator, whereby the pressing of the button moves the corresponding actuator to actuate the corresponding switch.

16. The in-sink dishwasher according to claim 15 wherein the plate has an opening through which the at least one actuator passes and the button overlies the opening.

17. The in-sink dishwasher according to claim 16 wherein the plate has a groove in the second surface and the gasket is positioned within the groove.

18. The in-sink dishwasher according to claim 17 and further comprising a second bowl adjacent the first bowl.

19. The in-sink dishwasher according to claim 8 wherein the user interface further comprises a template overlying the switches and at least partially seals the switches relative to the opening in the peripheral flange so that liquid on the peripheral flange at the opening cannot reach the switches.

20. The in-sink dishwasher according to claim 19 wherein the user interface further comprises a plate on which the template is mounted and which is in sealing arrangement with the peripheral flange.

21. The in-sink dishwasher according to claim 20 wherein the user interface further comprises a gasket positioned between the plate and the peripheral flange to place the plate in sealing engagement with the peripheral flange.

22. The in-sink dishwasher according to claim 21 wherein the gasket circumscribes the opening in the peripheral flange.

23. The in-sink dishwasher according to claim 22 wherein the gasket bears against a lower surface of the peripheral flange.

24. The in-sink dishwasher according to claim 23 wherein the plate has a channel in which the gasket is received.

25. The in-sink dishwasher according to claim 24 wherein the plate further comprises a projection located interiorly of the channel and comprises a peripheral wall and a generally planar upper surface, the template overlies the generally planar upper surface and extends at least partially along the peripheral wall, with the portion of the template extending at least partially along the peripheral wall abutting an edge of the peripheral flange forming the opening in the peripheral flange to at least partially seal the user interface relative to the sink.

26. The in-sink dishwasher according to claim 20 wherein the user interface further comprises a spacer disposed between the plate and the circuit board and overlying the plurality of switches, and a portion of the spacer abuts the plate to seal the circuit board relative to the plate.

27. The in-sink dishwasher according to claim 26 wherein the spacer is made from an elastic material.

28. The in-sink dishwasher according to claim 26 wherein the spacer further comprises a plurality of actuators, with each actuator corresponding to one of the switches such that the movement of an actuator actuates the corresponding switch.

29. The in-sink dishwasher according to claim 28 wherein there is an actuator for each switch.

30. The in-sink dishwasher according to claim 28 wherein the template has a plurality of buttons, with each button corresponding to one of the actuators, such that the movement of a button moves the corresponding actuator to actuate the corresponding switch.

31. The in-sink dishwasher according to claim 30 wherein there is a button for each actuator.

32. The in-sink dishwasher according to claim 30 wherein the user interface further comprises a bracket mounted to the sink and to which the circuit board is mounted to mount the circuit board to the sink.

33. The in-sink dishwasher according to claim 32 wherein the spacer abuts the bracket to seal the circuit board relative to the bracket.

34. The in-sink dishwasher according to claim 33 wherein the bracket has a channel substantially circumscribing the circuit board and the spacer has a rib that is received within the bracket channel to form a seal between the spacer and the bracket.

35. The in-sink dishwasher according to claim 34 wherein the circuit board is vertically oriented and the switches are located along an upper edge of the circuit board.

36. The in-sink dishwasher according to claim 35 wherein the bracket has a slot in which at least a portion of the circuit board is received to mount the circuit board to the bracket.

37. The in-sink dishwasher according to claim 36 wherein the bracket has a generally planar base in which the channel is formed, a side wall extending downward from the base, and at least one leg connecting the side wall to the base.

38. The in-sink dishwasher according to claim 37 wherein the slot extends through the base and into the at least one leg, whereby when the circuit board is mounted in the slot, the side wall serves to isolate the circuit board from the bowl.

39. The in-sink dishwasher according to claim 20 wherein the template is over molded onto the plate to mount the template to the plate.

40. The in-sink dishwasher according to claim 39 wherein the plate is a backing plate comprising a projection having a peripheral wall and a generally planar upper surface, with the template overlying the generally planar upper surface and extending at least partially along the peripheral wall.

41. The in-sink dishwasher according to claim 40 wherein the portion of the template extending along the peripheral wall abuts an edge of the peripheral flange forming the opening in the peripheral flange to form at least part of the seal between the template and the peripheral flange.

42. The in-sink dishwasher according to claim 41 wherein the template is made from a compressible material and is compressed at the interface with the edge of the peripheral flange to enhance the seal.

43. The in-sink dishwasher according to claim 1 wherein the faucet is configured for manually operation by a user to effect liquid introduction into the wash chamber.

44. The in-sink dishwasher according to claim 43 wherein the faucet is located in the peripheral flange.

45. The in-sink dishwasher according to claim 1 wherein the user interface comprises a selector for selecting at least one wash cycle for the dishwasher and the control system is configured to control the flow of liquid through the spray assembly to effect the selected wash cycle.

46. The ink-sink dishwasher according to claim 1 wherein the control system comprises a controller operably coupled to the user interface and configured to control the wash cycle.

47. An in-sink dishwasher for mounting in a conventional counter top to provide the user with the dual functionality of a sink and a dishwasher, the in-sink dishwasher comprising:

a sink having a bowl comprising a bottom wall from which extends a peripheral side wall that terminates in a peripheral flange, the bowl defining a wash chamber with an open top for receiving dishes to be washed, and the bowl sized to be inserted within an opening in the counter top and the peripheral flange sized to abut the counter top and limit insertion of the bowl;

a lid movably mounted to the sink for movement between an opened position permitting access to the wash chamber through the open top and a closed position where the lid covers the open top;

a control system for controlling the operation of the dishwasher and comprising a user interface located in the peripheral flange of the sink; and wherein the user interface comprises a plurality of switches that are accessible through an opening in the peripheral flange and a template overlying the switches and at least partially seals the switches relative to the opening in the peripheral flange so that liquid on the peripheral flange at the opening cannot reach the switches.

48. An in-sink dishwasher for mounting in a conventional counter top to provide the user with the dual functionality of a sink and a dishwasher, the in-sink dishwasher comprising:

a sink having a bowl comprising a bottom wall from which extends a peripheral side wall that terminates in a peripheral flange, the bowl defining a wash chamber with an open top for receiving dishes to be washed, and the bowl sized to be inserted within an opening in the counter top and the peripheral flange sized to abut the counter top and limit insertion of the bowl;

a lid movably mounted to the sink for movement between an opened position permitting access to the wash chamber through the open top and a closed position where the lid covers the open top; and a control system for controlling the operation of the dishwasher and comprising a user interface located in the peripheral flange of the sink, wherein the user interface comprises a template, a plate on which the template is mounted and which is in sealing arrangement with the peripheral flange and a gasket positioned between the plate and the peripheral flange to place the plate in sealing engagement with the peripheral flange.

* * * * *